US005171428A

United States Patent [19]

Beattie et al.

[11] Patent Number: 5,171,428

[45] Date of Patent: Dec. 15, 1992

[54] FLOTATION SEPARATION OF ARSENOPYRITE FROM PYRITE

[76] Inventors: Morris J. V. Beattie, 2955 W. 38 Avenue; Jean P. Duteroue, 777 Vinedale Road, both of Vancouver, B.C., Canada

[21] Appl. No.: 799,325

[22] Filed: Nov. 27, 1991 (Under 37 CFR 1.47)

[51] Int. Cl.[5] ..... B03D 1/002; B03D 1/02; B03D 1/06

[52] U.S. Cl. ..... 209/166; 209/167; 241/20; 241/24

[58] Field of Search ..... 209/166, 167; 252/61; 241/20, 24

[56] References Cited

U.S. PATENT DOCUMENTS

| | | | |
|---|---|---|---|
| 1,274,505 | 8/1918 | Bradford | 209/167 |
| 1,377,189 | 5/1921 | Dosenbach | 209/167 |
| 1,469,042 | 6/1922 | Hellstrand | 209/167 |
| 1,478,697 | 12/1923 | Bragg | 209/167 |
| 1,486,297 | 3/1924 | Pallanch | 209/167 |
| 1,678,259 | 7/1928 | Martin | 209/167 |
| 2,007,176 | 4/1933 | Brinker | 209/166 |
| 2,048,370 | 7/1936 | Brinker | 209/167 |
| 2,154,092 | 4/1939 | Hunt | 209/167 |
| 2,342,277 | 2/1944 | Herkenhoff | 209/167 |
| 2,512,669 | 6/1950 | Morrow | 209/167 |
| 3,919,080 | 11/1975 | Stauter | 209/167 |
| 4,283,017 | 8/1981 | Coale | 209/167 |
| 4,460,459 | 7/1984 | Shaw | 209/167 |
| 4,549,959 | 10/1985 | Armstrong et al. | 209/167 |
| 4,650,569 | 3/1987 | Vargas | 209/167 |
| 4,879,022 | 11/1989 | Clark et al. | 209/166 |
| 4,904,374 | 2/1990 | Singer | 209/166 |

FOREIGN PATENT DOCUMENTS

| | | | |
|---|---|---|---|
| 11248 | 11/1913 | Australia | 209/167 |
| 499430 | 4/1979 | Australia | 209/167 |
| 853248 | 10/1970 | Canada | 209/167 |
| 1238430 | 6/1988 | Canada | 209/167 |
| 202426 | 3/1966 | Sweden | 209/166 |

*Primary Examiner*—Stanley S. Silverman
*Assistant Examiner*—Thomas M. Lithgow

[57] ABSTRACT

Arsenopyrite is separated from a mixture with pyrite by contacting the mixture with a sulfitic agent providing $HSO_3^-$ ions at elevated temperature and pH below about 8 for a period sufficient to impart a selective depression property to the arsenopyrite. On addition of a collector the pyrite is rendered floatable, enabling froth flotation to achieve a concentrate rich in pyrite and tailings rich in arsenopyrite.

16 Claims, 2 Drawing Sheets

FLOTATION SEPARATION OF ARSENOPYRITE FROM PYRITE

Figure 1:
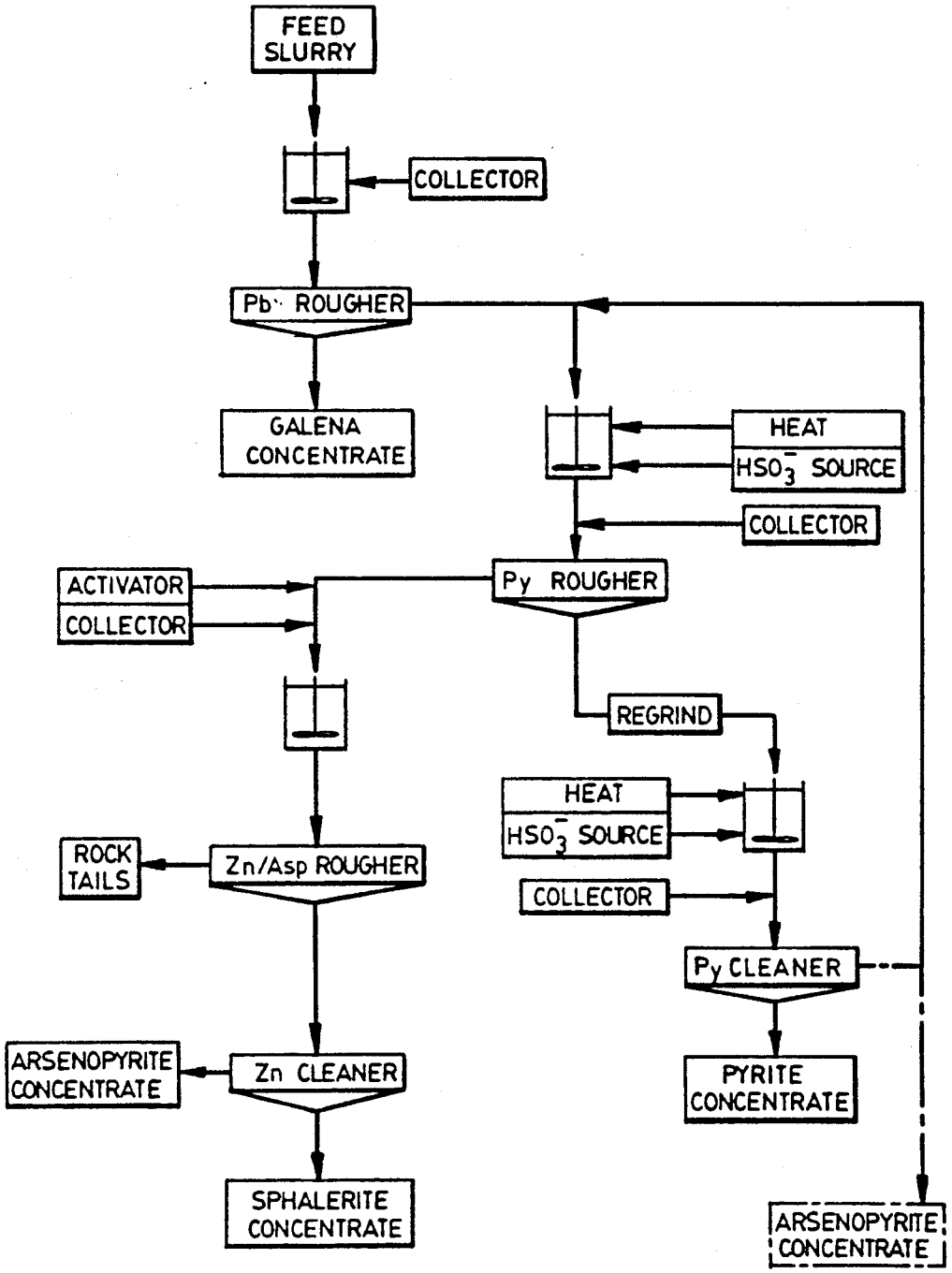

This invention relates to beneficiation of ores and, more particularly, to a process that preferentially renders arsenopyrite (FeAsS) unfloatable while leaving pyrite ($FeS_2$) floatable.

In many parts of the world, pyrite and arsenopyrite occur together in sulfide ores either as the only sulfide minerals or in conjunction with other valuable sulfides. It is desirable to produce separate concentrates of the various sulfide minerals, including pyrite and arsenopyrite so that the contained desirable metals can be recovered economically. It is common for instance for gold in an ore containing both pyrite and arsenopyrite to be associated almost exclusively with the arsenopyrite. It is desirable in this instance to produce an arsenopyrite concentrate for gold recovery while rejecting the barren pyrite.

In the froth flotation process it is common for pyrite and arsenopyrite to respond in a similar manner to the process conditions and so report to a combined concentrate. The ratio of pyrite to arsenopyrite in such a concentrate may be as high as 5:1. The viability of recovering any contained gold from such a concentrate by means of subsequent processing may be reduced or eliminated due to the cost of treating the pyrite. In the past it has been proposed to depress one or the other of the two minerals in such a combined concentrate through the addition of various agents such as lime, cyanide or permanganate. U.S. Pat. No. 2,342,277 for instance teaches the use of an alkali metal permanganate to depress arsenopyrite from such a concentrate while leaving the pyrite floatable.

The production of separate concentrates from a bulk concentrate through the use of depressants such as permanganate has been attempted for numerous ores. In some cases the attempts have been made on a commercial scale but in each case the results achieved have been unacceptable and the separation has proven to be difficult to control. Similarly, the use of other depressants such as cyanide has proven to be unreliable for separating the two minerals. There is presently no known successful commercial application of a pyrite—arsenopyrite differential flotation process.

The use of sulfur dioxide for depressing sphalerite (ZnS) during the flotation of pyrite is well established. Similarly, Canadian patent 1,238,430 teaches the use of sulfur dioxide to separate copper and iron sulfides from the nickel sulfide, pentlandite ($(FeNi)_9S_8$). The use of this reagent for the separation of pyrite and arsenopyrite does not appear to have been described heretofore.

U.S. Pat. No. 2,154,092 discloses conditioning a concentrate pulp in order to depress carbonaceous gangue by adding sulfur dioxide for I5 minutes and subjecting the conditioned pulp to froth flotation in the presence of flotation reagent and obtaining flotation of pyrite together with arsenopyrite and elemental gold, and does not disclose a process separating pyrite from arsenopyrite.

It has now been found that when a pulp comprising pyrite and arsenopyrite is conditioned at elevated temperature by adding to it sulfur dioxide in sufficiently large quantities, or other compounds providing $HSO_3$ ion provided that an approximately neutral or acid pH less than about pH 8 is maintained, the arsenopyrite has a property imparted to it such that it is selectively depressed in the presence of collector effective to float sulfide minerals while the pyrite is not so depressed, at least to the same extent. The selective depression of the arsenopyrite allows separation of the latter from pyrite.

Accordingly the invention provides a froth flotation process for effecting separation of arsenopyrite mineral from pyrite mineral comprising conditioning at pH less than about 8 and at elevated temperature an aqueous pulp containing particles of said arsenopyrite and pyrite minerals, said conditioning being conducted with a sulfitic depressing agent providing $HSO_3$ ions added to said pulp in a quantity sufficient to impart a selective depression property to said arsenopyrite particles in the pulp, adding to the conditioned pulp a collector effective to cause flotation of sulfide minerals, subjecting the pulp containing the collector to froth flotation, and recovering a concentrate froth relatively rich in pyrite mineral and separately a tailings relatively rich in arsenopyrite mineral.

With the process of the present invention, a low arsenic, pyrite concentrate can be removed with minimal loss of any gold associated with the arsenopyrite. Once the pyrite has been removed, the arsenopyrite can be activated according to procedures known in themselves for activation of arsenopyrite and a high arsenic, high gold concentrate can be produced.

The sulfitic depressing agent is preferably $SO_2$ gas which is bubbled into the pulp to achieve conditioning and which initially forms a solution of sulfurous acid ($H_2SO_3$) hence providing $HSO_3$ ions in solution and tending to render the pulp acidic. It is necessary that the pulp should be approximately neutral or at acidic pH and should have a pH less than about 8 after the conditioning process. If the pulp is conditioned to a pH higher than about 8 both pyrite and arsenopyrite are strongly depressed and it is not practicable to effect a separation by flotation of pyrite from the conditioned pulp. Preferably, the pH in the conditioning step is about pH 3.5 to about pH 7. Other sources of $HSO_3$ ions which may be used as the sulfitic depressing agent include sulfite, metabisulfite, bisulfite and thiosulfate salts, for example alkali metal sulfites, bisulfites, metabisulfites and thiosulfates, such as sodium sulfite, sodium bisulfite, sodium metabisulfite or sodium thiosulfate. Mixtures of two or more of the above sulfitic agents may also be used.

In the case in which the sulfitic depressing agent is a basic salt such as sodium sulfite, it is necessary to add an acid, preferably a strong acid, along with the basic salt in order to achieve the desired approximately neutral or acidic pH of less than about pH 8. As the acid, there may be employed any acid which is compatible with the components of the pulp and the reagents used, but preferably the acid is sulfuric acid, since, unlike other commonly used strong mineral acids, it lacks strongly oxidizing character and does not produce objectionable by-products such as chlorine.

In order to achieve conditioning, it is necessary that the pulp should be contacted with a sufficient quantity of the sulfitic agent. Usually it is desirable that the pulp be agitated continuously in contact with the sulfitic agent, and that the conditioning be allowed to continue for a sufficient period before the flotation separation takes place.

The quantity of the sulfitic reagent which needs to be contacted with the pulp in order to achieve conditioning is dependent to some extent on the composition of the pulp and with any given pulp it is, of course, possible to determine by trial and experiment the quantity of sulfitic agent which needs to be contacted with the pulp. In the case in which the sulfitic agent is sulfur dioxide, preferably the sulfur dioxide is added in sufficient quantity to achieve a pH of about 3.5 to about 7, more preferably pH 5.0 to about 6.0. More generally, the quantity of sulfitic reagent added is preferably sufficient to provide about 2 to about 35 kg $HSO_3$ ions (calculated as $SO_2$), per tonne (metric tonne) of the ore undergoing treatment In some cases, the conditioning is conducted on a pulp formed from tailings from which an initial concentrate, for example a galena concentrate has been separated. Since the quantity of such concentrate is usually small in relation to the quantity of the ore, the preferred quantity of sulfitic reagent may be considered to be about 2 to about 35 kg (calculated as $SO_2$) based on the weight of solids present in the pulp undergoing conditioning.

As noted above, the conditioning is conducted with the pulp heated to elevated temperature. At room temperature, e.g. around 20° C., no noticeable conditioning occurs within practicable time spans of less than a few hours. That is to say, the arsenopyrite does not acquire a selectively depressed property and remains floatable to the same extent as the pyrite.

The higher the temperature at which the conditioning is conducted, the more rapidly the conditioning is achieved. Preferably, the conditioning is conducted at a temperature of at least about 30° C., the upper limit of temperature being limited only by the decomposition of the reagents in the system. To avoid the need for pressurization of the vessels in which the conditioning is conducted, preferably the conditioning temperature is less than the boiling point of the slurry undergoing conditioning. To further reduce energy costs while keeping the period required for conditioning within acceptable limits, more preferably the conditioning is conducted at a temperature of about 30° to about 80° C., still more preferably about 40° to about 70° C., at which temperatures conditioning can typically be completed in about 10 to about 30 minutes, more preferably about 20 minutes.

The mechanism by which the sulfitic depressing agent operates is not presently fully understood, but appears to involve a surface chemical and electrochemical effect with the arsenopyrite surface gaining and/or losing electrons. Concomitantly, the $HSO_3$ ions offered to the system by the sulfitic agent undergo transformation to sulfur containing species other than $HSO_3$, so that $HSO_3$ ions may no longer be detectable by the end of the conditioning period.

The collector employed in the flotation process may be any collector effective to promote flotation of sulfide minerals and preferably is particularly effective in flotation of pyrite. Examples of suitable collectors include xanthate, for example alkali metal isopropyl xanthate, and alkali metal isobutyl xanthate, dixanthogen, xanthate esters, dithiophosphates, dithiocarbonates, thithiocarbonates, mercaptans, and thionocarbonates. A discussion of various collectors which may be employed in the process of the present invention is contained in U.S. Pat. No. 4,879,022 (Clark et al) which is incorporated by reference herein. Some of these collectors, especially xanthates, are degraded or destroyed by hot acid conditions and therefore it may be necessary to effect the flotation within a short time span after the collector has been added. Alternatively the process uses staged additions of collector when a quantity of collector is added, a concentrate recovered and then the process repeated with successive additions of collector, and the concentrates from all these flotations combined to obtain a concentrate. In continuous processing such staged flotations are conducted in a plurality of successive flotation cell stages to each of which collector is added, and wherein the tailings from each cell are passed to the succeeding cell, and the froth concentrates from the various stages are combined.

Figure 2:
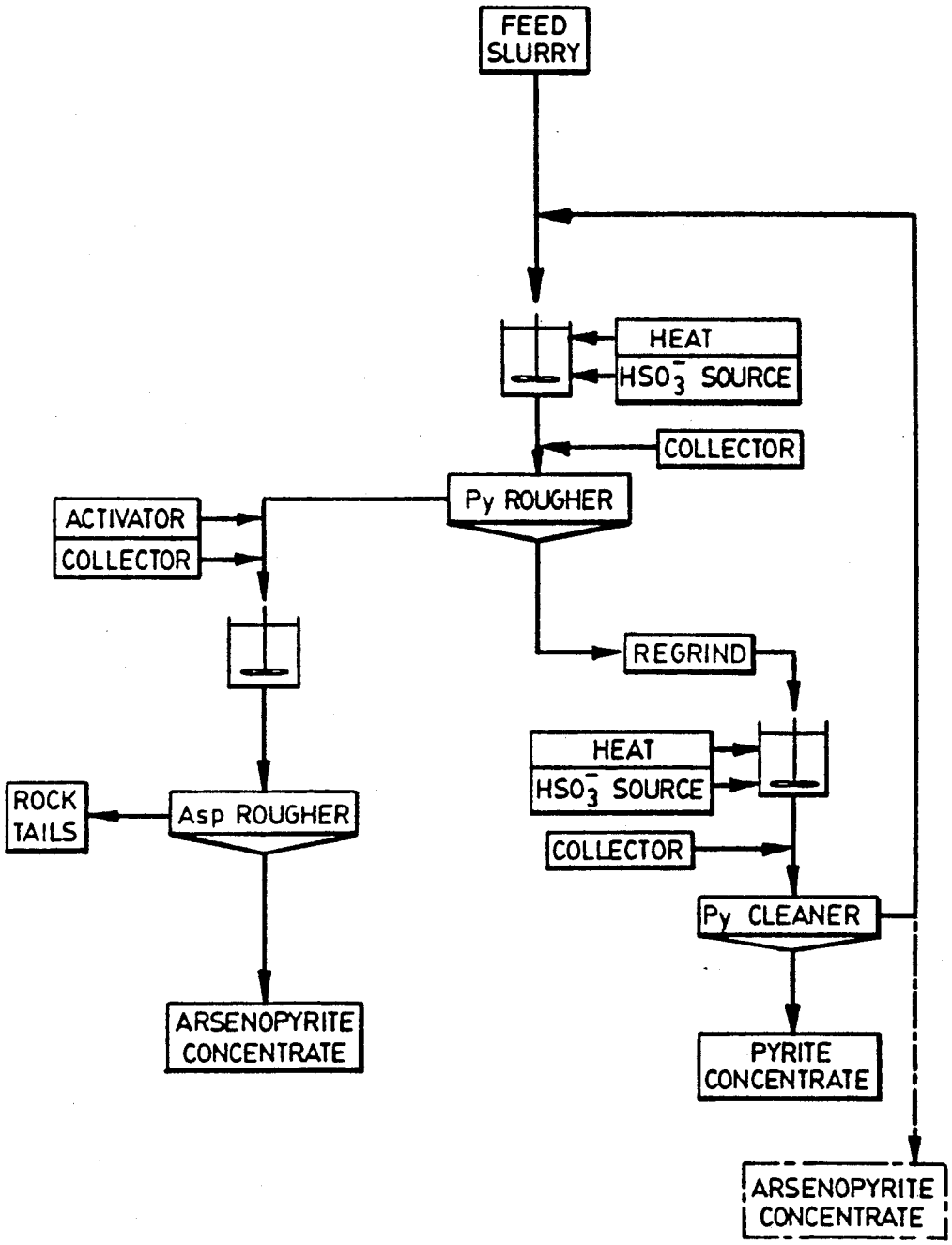

The process will now be described in more detail, by way of example only, with reference to the accompanying drawings wherein:

FIG. 1 shows a schematic flow sheet of a process in accordance with the invention for a complex ore; and FIG. 2 shows a similar flow sheet for a more simple ore.

In the example of FIG. 1 the ore is complex and comprises galena (Pbs), sphalerite, pyrite and arsenopyrite. Merely by way of example, it may be mentioned that one group of ores to which the invention may advantageously be applied will comprise, in approximate percentages by weight based on the total weight of the ore:

0 to 20% galena
0 to 20% sphalerite
3 to 30% pyrite
3 to 25% arsenopyrite
balance rock (gangue)

The ore is subjected to size reduction by crushing and grinding to bring it to a fine particle size suitable for froth flotation processing. The grinding may, by way of example, be conducted to 50 to 90% by weight passing 200 mesh (Tyler Standard Sieve) (74 microns). The ground ore is slurried with water to form a feed slurry or pulp for froth flotation processing. When galena is present as shown in FIG. 1 it is desirable to remove the galena, which tends to float quite readily, in an initial flotation. Otherwise, the galena would report to the concentrate obtained in the subsequent pyrite rougher stage. As shown in FIG. 1 the pulp is agitated with a small amount of a collector, for example sodium ethyl xanthate, suitable for promoting flotation of the galena without causing flotation of the other sulfide minerals present, and the galena concentrate floated off in the conventional manner in galena rougher stage indicated as Pb rougher in FIG. 1. The conditions employed in the flotation, and in the other flotations described herein, may be those of conventional flotation processes and the details of such conditions, for example as to solids contents, rates of bubbling, etc., are well known to those skilled in the art and need not be described herein.

The tailings from the galena rougher are conditioned as described above to depress arsenopyrite, by agitating the tailings at elevated temperature in contact with the sulfitic agent, most preferably by heating to about 60° C., agitating the pulp, and adding $SO_2$ to achieve a pH of about 5, and then monitoring the pH and making additions of $SO_2$ periodically as necessary over about 20 minutes to maintain the pH at about pH 5. In the preferred form, following the conditioning period no minerals are floatable when gas bubbles are introduced into the conditioned pulp. The conditions that may be employed in the conditioning step, for example solids content of the pulp, intensity of and forms of agitation, may be as employed in conventional conditioning processes as well known to those skilled in the art and again need not be described herein in detail.

A collector, for example xanthate or other collector as discussed above, preferably sodium isobutylxanthate, is then added to the conditioned pulp in quantities sufficient to make the pyrite floatable, and a pyrite rougher flotation is carried out in conventional manner, either in one stage, indicated as Py rougher in FIG. 1, or in a plurality of stages as discussed above. Where the collector is destroyed by the hot acidic condition of the pulp, the collector must be added at a high enough rate of addition that it is effective, and the flotation conducted sufficient quickly after the addition of the collector, to cause flotation of the pyrite. Depending on the quantity of collector added, some arsenopyrite will float along with the pyrite and be recovered in the concentrate, or in the combined concentrates if a plurality of rougher stages are employed. In the preferred form, a quantity of collector is added such that the concentrate contains less than about 10% by weight arsenopyrite, based on the total solids weight of the concentrate, more preferably less that about 5%. When higher quantities of collector are added, an increasing amount, up to substantially all of the arsenopyrite present, together with the pyrite, may be made to report to the rougher concentrate.

Depending on the composition of the ore, the feed pulp may contain particles of mixed composition, consisting partly of pyrite and partly of arsenopyrite, and these mixed particles will tend to report to the rougher concentrate. In such case, in order to liberate the arsenopyrite, the concentrate is reground to a particle size smaller than the original grind, for example about 100% passing 400 mesh (TSS).

The froth concentrate from the pyrite rougher, with or without regrinding, and after addition of water if necessary to achieve a desirable solids content and consistency suitable for froth flotation processing, is conditioned to depress arsenopyrite while allowing flotation of pyrite, preferably using the same reactants, temperature and times as described above for the conditioning before the pyrite rougher. A collector is added promoting flotation of pyrite, preferably a xanthate, more preferably sodium isobutyl xanthate, and the pulp is subjected to a pyrite cleaning froth flotation, as indicated by Py cleaner in FIG. 1, in the conventional manner. The pyrite froth concentrate is collected. In the preferred form the tailings comprise only a small quantity of arsenopyrite and are returned, as indicated by the solid line indicating material flow in FIG. 1, to the conditioning stage for the pyrite rougher. In the case in which the pyrite rougher is operated with a high level of utilization of the collector, so that the tailings from the pyrite rougher are substantially free from arsenopyrite, and substantially all the arsenopyrite reports to the pyrite rougher froth concentrate, the tailings from the Py cleaner stage provides the final arsenopyrite concentrate and is collected separately as shown by the broken line in FIG. 1.

In the preferred form, the tailings from the pyrite rougher will contain substantial quantities of arsenopyrite, for example more than about 10% based on the total solids weight of the tailings, together with the sphalerite and gangue particles.

If desired, the tailings may be conditioned to depress arsenopyrite and a sphalerite concentrate floated off, and then an activator added to the tailings to obtain flotation of arsenopyrite. However, this procedure is not desirable as flotation of the sphalerite while maintaining the arsenopyrite depressed requires additions of basic reagents to achieve a basic pH and there is increased consumption of the basic reagent since the tailings from the pyrite rougher are somewhat acidic.

Preferably, therefore, the tailings from the pyrite rougher are treated to activate the arsenopyrite using a conventional arsenopyrite activator as shown in FIG. 1, and a combined arsenopyrite/sphalerite concentrate obtained. Typically, the activator is a source of cupric copper ions, for example copper sulfate but any known activator for arsenopyrite may be employed. A sulfide mineral collector, for example a xanthate, preferably isopropyl xanthate, is then added and flotation carried out in the conventional manner in a zinc and arsenopyrite rougher stage, indicated in FIG. I by Zn/Asp rougher, to float the combined sphalerite and arsenopyrite concentrate. The tailings, consisting of gangue particles, are discarded. A base, for example lime (CaO), may then be added to bring the concentrate pH to above about 9, preferably to about pH 11 and a depressant such as a source of cyanide ions, for example sodium cyanide, is added as depressant for the arsenopyrite. If necessary, water is added to achieve a pulp with a solids content and consistency suitable for froth flotation. A collector for sulfide mineral, for example a xanthate and preferably isopropyl xanthate, is then added and the pulp subjected to conventional froth flotation in a zinc cleaner stage indicated in FIG. 1 as Zn cleaner. The froth concentrate containing sphalerite is recovered separately from the tailings which form the arsenopyrite concentrate product.

In the case in which the tailings from the pyrite rougher contain sphalerite and substantially no arsenopyrite, the arsenopyrite activation and Zn/Asp rougher stages may be omitted and the tailings subjected directly to conventional Zn rougher and Zn cleaner stages.

FIG. 2 illustrates a schematic flow sheet for a more simple ore comprising only pyrite, arsenopyrite and gangue. The pulp of the ore is prepared by crushing, grinding and slurrying with water as described above in connection with FIG. 1. In this case however, the feed slurry or pulp is directly subjected to conditioning in the same manner as the tailings from the rougher as described above. In the preferred form the collector is added and the Py rougher stage conducted to provide a froth concentrate which is substantially free from arsenopyrite, and contains less than about 10% arsenopyrite by weight based on the total weight of solids in the concentrate. The concentrate is reground as described above with reference to FIG. 1 to liberate arsenopyrite from mixed particles. The ground and reslurried concentrate, after conditioning as described above is subjected to a pyrite froth flotation cleaner stage under the conditions described above with reference to FIG. 1. A pyrite-rich froth concentrate is recovered and tailings are recovered separately. In the preferred form the tailings comprise only a small quantity of arsenopyrite and are returned to the feed to the conditioning for the Py rougher stage. Where, however, the Py rougher is operated in such manner that substantially all the arsenopyrite reports to the Py rougher concentrate, the tailings from the Py cleaner stage constitute the arsenopyrite concentrate product and are collected, while the tailings for the Py rougher stage, which are barren in pyrite and arsenopyrite, are normally discarded.

In the preferred form, the arsenopyrite rich tailings from the Py rougher stage are treated to activate arsenopyrite in the manner described above before the Zn/Asp rougher stage in FIG. 1 and are after addition of collector as described above for the Zn Asp rougher stage are subjected to conventional froth flotation as indicated in FIG. 2 by a Asp rougher stage to obtain an arsenopyrite rich concentrate product, and barren tailings which are normally discarded.

The following Examples illustrate in more details the process described herein.

The ore used for these Examples came from a deposit in central British Columbia, Canada. This material was selected as being appropriate for the Example test work since it contained both pyrite and arsenopyrite and the effective separation of these minerals was critical to the development of the deposit. It should be appreciated, however, that the disclosed process may be utilized with ores comprising pyrite and arsenopyrite regardless of the source.

The feed in this instance analyzes about 5% galena, 10% sphalerite, 25% pyrite, 12% arsenopyrite and the balance rock.

After crushing, grinding and slurrying, the galena was removed from the ore in a lead rougher flotation step in conventional manner using sodium ethyl xanthate as collector and a tailings obtained containing about 11% sphalerite, 26% pyrite, 13% arsenopyrite and the balance rock. The tailings the lead rougher formed the starting material for the Examples below.

EXAMPLE 1

The lead rougher flotation tailings were conditioned for 20 minutes at 73° C. with $SO_2$ being added until the slurry pH decreased to 5.2. The pH was monitored and small additions of $SO_2$ were made as necessary during the conditioning period to maintain the pH at this level. Following the conditioning period, the slurry was transferred to a laboratory flotation cell. Xanthate was added to the slurry in three stages in order to maintain a pyrite float. The concentrate removed after each xanthate addition was collected and analyzed separately. The results summarized in Table 1 (percentages herein are all by weight) indicate that a high grade pyrite concentrate containing little arsenopyrite was produced from the lead rougher tails.

TABLE 1

| Pyrite Rougher Flotation Results | | | | |
|---|---|---|---|---|
| | | | Recovery, % | |
| Product | % FeAsS | % $FeS_2$ | FeAsS | $FeS_2$ |
| Py Conc. 1 | 1.9 | 91.3 | 2.1 | 52.3 |
| Py Conc. 2 | 2.3 | 85.0 | 0.7 | 13.7 |
| Py Conc. 3 | 3.7 | 76.2 | 0.7 | 7.7 |

The pyrite rougher flotation tailings in this example were treated differently than as shown in FIG. 1. Instead of floating a bulk sphalerite-arsenopyrite concentrate, the arsenopyrite was depressed during sphalerite flotation using additions of base, cyanide, and xanthate collector and then subsequently activated with copper sulfate and collector and floated. This procedure produced a concentrate assaying 37.6% As (81.7% FeAsS).

EXAMPLE 2

The lead rougher flotation tailings were conditioned for 20 minutes at 65° C. with $SO_2$ being added to maintain a pH of 5.0. From the $SO_2$ gas flow, it was calculated that the $SO_2$ consumption over the conditioning period was 2 kg/tonne ore (based on the weight of ore fed to the lead rougher flotation step). Following the conditioning period, the slurry was transferred to a flotation cell and a pyrite concentrate was removed for 5 minutes following an addition of 20 g/tonne sodium isobutyl xanthate. (All references to g/tonne herein are based on the original weight of ore fed to the lead rougher flotation step, unless otherwise indicated). A second, scavenger concentrate was removed for 3½ minutes following a further addition of 20 g/tonne sodium isobutyl xanthate. The results achieved in these two stages of flotation are summarized in Table 2.

TABLE 2

| | | | Recovery, % | |
|---|---|---|---|---|
| Product | % FeAsS | % $FeS_2$ | FeAsS | $FeS_2$ |
| Pyrite Rougher | 2.5 | 83.3 | 1.3 | 23.4 |
| Pyrite Scav. | 3.1 | 73.7 | 4.2 | 52.8 |

The pyrite scavenger tailings were conditioned with 60 g/tonne $CuSO_4$ and 80 g/tonne isopropyl xanthate for 2 minutes. A bulk sphalerite-arsenopyrite concentrate assaying 19.4% As (42.1% FeAsS) was produced by this procedure. Following regrinding, the bulk concentrate was conditioned with 30 g/tonne NaCN and lime to pH 11.4 prior to the sphalerite being floated with 5 g/tonne isopropyl xanthate, leaving a tailing containing 30% As (65.2% FeAsS) which represents the arsenopyrite concentrate product.

The final tailing from the sphalerite-arsenopyrite rougher in this test contained only 3.6% of the arsenopyrite which was present in the feed originally made to the lead rougher.

EXAMPLE 3

In this example, the lead rougher tailings were conditioned for 20 minutes at 60° C. and with $SO_2$ additions to pH 5.0. A pyrite rougher concentrate was subsequently floated with staged additions totalling 75 g/tonne isobutyl xanthate. The concentrate contained 69.5% pyrite and 10.3% arsenopyrite. The pyrite rougher concentrate was reground in a laboratory rod mill for 20 minutes and was then conditioned at 60° C. for 20 minutes, with $SO_2$ additions to pH 5.0. Following this conditioning, the pyrite was refloated in four stages with isobutyl xanthate additions and for the times summarized together with the results obtained in Table 3.

TABLE 3

| Cleaner Flotation of Pyrite Concentrate | | | | |
|---|---|---|---|---|
| Product | Time (min) | Xanthate (g/tonne) | $FeS_2$ % | FeAsS % |
| Conc. 1 | 0–1 | 10 | 84.4 | 4.3 |
| Conc. 2 | 1–2 | 10 | 91.9 | 2.3 |
| Conc. 3 | 2–3½ | 10 | 93.0 | 1.9 |
| Conc. 4 | 3½–6 | 10 | 76.4 | 14.0 |
| Cleaner Tail | — | — | 22.0 | 22.6 |

The results of this Example demonstrate the application of the process of the present invention to improving the separation of a previously floated pyritearsenopyrite concentrate. In conducting the Example separation, it was noted that the conditioning time with $SO_2$ is an important parameter. After 5 minutes conditioning, the arsenopyrite was still observed to be floating to some degree. By 10 minutes, such flotation appeared to be minimal, but conditioning was continued to 20 minutes to ensure that an effective separation was achieved.

The results also illustrate that increased arsenopyrite will float if flotation is continued beyond the point where a substantial portion of the pyrite has been removed. For concentrate no. 4, it was visually apparent that arsenopyrite was reporting to the froth.

EXAMPLE 4

A series of tests were conducted to demonstrate the effect of varying the quantity and rate of xanthate addition following conditioning with $SO_2$. The results summarized in Table 4 show a wide variation in pyrite and arsenopyrite recovery to the rougher concentrate. In test F1, the xanthate was added in small increments and was apparently destroyed by the hot, acidic conditions before it could activate the pyrite. In tests F2 and F3, an initial addition of 50 g/tonne xanthate was made followed by the balance after 2 minutes flotation.

TABLE 4

Test Results with Varying Xanthate Addition

| Test No. | Xanthate (g/tonne) | Recovery, % $FeS_2$ | Recovery, % FeAsS |
|---|---|---|---|
| F1 | 80 (staged) | 28.5 | 1.63 |
| F2 | 90 | 79.8 | 64.1 |
| F3 | 75 | 69.1 | 40.2 |

It has been noted in performing the tests that once the xanthate has been added, the concentrate must be removed as quickly as possible or the xanthate will decompose, resulting in a loss of recovery.

EXAMPLE 5

A series of tests were conducted in which the parameters for conditioning with $SO_2$ ahead of pyrite flotation were varied. The results of these tests summarized in Table 5 indicate the process to be operable across a range of conditions, although the use of conditioning times of less than 20 minutes appeared to result in increased arsenopyrite floatability.

TABLE 5

Effect of Conditioning Parameters on Pyrite and Arsenopyrite Recovery

| Conditioning Parameters | Recovery % $FeS_2$ | Recovery % FeAsS |
|---|---|---|
| 20 min, 40° C., pH 5 | 39.8 | 6.7 |
| 10 min, 60° C., pH 5 | 57.2 | 16.7 |
| 20 min, 60° C., pH 6 | 51.0 | 6.6 |

As is demonstrated by the above Examples, the use of sulphur dioxide conditioning enables a pyrite concentrate, low in arsenic, to be produced from an ore slurry containing both pyrite and arsenopyrite. The arsenopyrite which remains in the slurry at this point can be recovered in a subsequent flotation step using reagents which are commonly used in arsenopyrite flotation, such as copper sulphate and xanthate.

The Examples were conducted on a complex ore which contained sulphides other than pyrite and arsenopyrite. For simpler ores containing only these two minerals, the overall flow sheet would obviously be simplified. For such an ore, the conditioning parameters and even more so the quantity and rate of xanthate addition would have to be optimized to ensure selective flotation conditions.

While the above Examples have illustrated various forms of application of the process, there are numerous variations that may be made. For example, the conditioning step can vary as to the use of sulphite salts rather than gaseous $SO_2$, etc. and the flotation of pyrite can be performed with collectors other than xanthate. Variations and modifications of the process as may be practised and as will occur to the skilled reader are not intended to be excluded from the scope of the claims to follow.

We claim:

1. A froth flotation process for effecting separation of arsenopyrite mineral from pyrite mineral comprising conditioning at pH less than about 8 and at a temperature of at least about 30° C. and aqueous pulp containing particles of said arsenopyrite and pyrite minerals, said conditioning being conducted with a sulfitic depressing agent providing $HSO_3$ ions added to said pulp in a quantity sufficient to impart a selective depression property to said arsenopyrite particles in the pulp, adding to the pulp a collector effective to cause flotation of pyrite mineral, subjecting the conditioning pulp in the presence of said collector to froth flotation, and recovering a concentrate froth relatively rich in pyrite mineral and separately a tailings relatively rich in arsenopyrite mineral.

2. Process as claimed in claim 1 wherein said pH is 3.5 to about 7.

3. Process as claimed in claim 2 wherein said pH is about 5 to about 6.

4. Process as claimed in claim 1 wherein said elevated temperature is about 30° C. up to the boiling point of the pulp undergoing conditioning.

5. Process as claimed in claim 4 wherein said elevated temperature is about 30° C. to about 80° C.

6. Process as claimed in claim 5 wherein said elevated temperature is about 40° C. to about 70° C.

7. Process as claimed in claim 1 wherein said sulfitic depressing agent comprises sulfur dioxide, a sulfite, bisulfite, metabisulfite or thiosulfate salt, or a mixture of two or more thereof.

8. Process as claimed in claim 7 wherein said agent is sulfur dioxide.

9. Process as claimed in claim 1 wherein said conditioning is conducted for a period of about 10 to about 30 minutes.

10. Process as claimed in claim 9 wherein said period is about 20 minutes.

11. Process as claimed in claim 1 wherein said sulfitic depressing agent is added in a quantity providing a weight of about 2 to about 35 kg $HSO_3$ ions (calculated as $SO_2$) per tonne of solids present in the pulp.

12. Process as claimed in claim 1 wherein said pulp and said arsenopyrite rich tailings each contain gangue particles, and including the steps of activating said tailings with an activator agent for arsenopyrite, subjecting the activated tailings to froth flotation in the presence of a collector for arsenopyrite, and recovering a concentrate froth rich in arsenopyrite and separately a tailings substantially barren of arsenopyrite.

13. Process as claimed in claim 12 wherein said activator agent is a source of copper ions.

14. Process as claimed in claim 1 wherein said pulp comprises a concentrate substantially free from gangue particles.

15. Process as claimed in claim 14 wherein the concentrate comprises particles each consisting partly of pyrite and partly of arsenopyrite and including the step of grinding the concentrate particles to liberate the arsenopyrite from the pyrite particles before subjecting said pulp to said conditioning.

16. A process as claimed in claim 1 wherein the collector is added after conditioning of the pulp.

* * * * *